US006581990B1

(12) United States Patent
Menke et al.

(10) Patent No.: US 6,581,990 B1
(45) Date of Patent: Jun. 24, 2003

(54) POWER-CLOSING BOLT FOR MOTOR-VEHICLE DOOR LATCH

(75) Inventors: Johannes-Theodor Menke, Velbert (DE); Ulrich Nass, Mulheim (DE)

(73) Assignee: Kiekert AG, Heiligenhaus (DE)

( * ) Notice: Subject to any disclaimer, the term of this patent is extended or adjusted under 35 U.S.C. 154(b) by 72 days.

(21) Appl. No.: 09/722,255

(22) Filed: Nov. 24, 2000

(30) Foreign Application Priority Data

Nov. 26, 1999 (DE) ..... 199 57 061

(51) Int. Cl.[7] ..... E05B 15/02

(52) U.S. Cl. ..... 292/341.16; 292/201; 292/340; 292/341.15; 292/341.17

(58) Field of Search ..... 292/341.16, 341.15, 292/341.17, 340, 201, DIG. 43

(56) References Cited

U.S. PATENT DOCUMENTS

| | | | | | |
|---|---|---|---|---|---|
| 2,916,319 | A | * | 12/1959 | Du Bois | 292/341.16 |
| 3,416,826 | A | * | 12/1968 | Putsch et al. | 292/341.16 |
| 3,563,588 | A | * | 2/1971 | Putsch et al. | 292/198 |
| 3,591,225 | A | * | 7/1971 | Hagemeyer | 292/340 |
| 4,775,178 | A | | 10/1988 | Boyko | |
| 4,842,313 | A | | 6/1989 | Boyko et al. | |
| 5,033,282 | A | * | 7/1991 | Gartner et al. | 70/278 |
| 5,044,184 | A | * | 9/1991 | Herbers et al. | 70/277 |
| 5,217,266 | A | * | 6/1993 | Köstler | 292/201 |
| 5,765,886 | A | * | 6/1998 | Buchanan | 292/346.16 |
| 5,785,364 | A | * | 7/1998 | Kleefeldt et al. | 292/201 |
| 5,829,114 | A | * | 11/1998 | Kleefeldt | 29/468 |
| 5,896,765 | A | * | 4/1999 | Peyre et al. | 70/186 |
| 6,167,770 | B1 | * | 1/2001 | Nass | 74/425 |
| 6,176,528 | B1 | * | 1/2001 | Taga | 292/341.16 |

FOREIGN PATENT DOCUMENTS

| | | |
|---|---|---|
| DE | 3401 842 A1 | 8/1985 |
| DE | 4210 893 A1 | 10/1993 |
| EP | 0 467 057 B1 | 1/1992 |

* cited by examiner

*Primary Examiner*—Robert J. Sandy
*Assistant Examiner*—Carlos Lugo
(74) *Attorney, Agent, or Firm*—Herbert Dubno; Andrew Wilford

(57) ABSTRACT

A power-closing bolt assembly for a motor-vehicle door latch has a housing, a bolt pivotal in the housing about a pivot axis between a pair of angularly offset end positions, and interengaging bolt and housing abutments respectively on the bolt and on the housing bearing angularly of the pivot axis on each other in each of the end positions. A drive displaces the bolt between the end positions. The housing abutments are spaced apart relative to the pivot axis by more than 180°.

13 Claims, 5 Drawing Sheets

POWER-CLOSING BOLT FOR MOTOR-VEHICLE DOOR LATCH

FIELD OF THE INVENTION

The present invention relates to a motor-vehicle door latch. More particularly this invention concerns a power-closing bolt for such a latch.

BACKGROUND OF THE INVENTION

A motor vehicle door is normally provided on its outer edge opposite its hinged edge with a latch having a fork engage able around a bolt projecting from a door post. The fork can retain the bolt to hold the door closed, and can pivot to release the bolt and allow the door to be opened. On closing the fork is automatically latched the door in the door opening against an annular seal typically carried on the vehicle body.

In today's vehicles it is important that the door be as tightly closed as possible, in order to reduce drafts and noise. Thus the door should, in the closed position, exert the maximum possible compression on the door seal. This effect is most simply achieved by only letting the latch engage in its end position when the door is forcibly closed, requiring the user to pull or push it solidly to.

Better vehicles incorporate a power-closing system which, once the fork has latched around the bolt, displaces the bolt inward through a short extra stroke that ensures that the door will be tightly closed. The system can also move the bolt outward through its stroke when one of the latches is initially actuated to open the door. In this manner the user is not burdened with having to close a door very tightly, or deal with opening a very tightly closed door. In practice such a system allows a door to be pulled much more tightly closed than could normally be expected by a standard system. These arrangements are also usable on the trunk door as they allow the user to merely push the door to and thereafter it will fully close by its own automatic operation.

Such power closing systems work various ways. In U.S. patent application Ser. No. 09/338,036 filed Jun. 22, 1999, U.S. Pat. Nos. 4,775,178 and 4,842,313, European patent 0,467,057 of U. Koster, and German patent document 4,210, 893 published 7 Oct. 1993 for P. Szablewski the bolt is mounted slightly eccentrically on a rotary mount that is driven by an electric motor through a step-down transmission. Pivoting the bolt through 180° moves it through a distance equal to twice the eccentric offset of the bolt from its rotation axis, displacing the door from an outer partially closed position to an inner fully closed position. In other systems shown in German patent document 3,401,842 published Aug. 1, 1985 the bolt is mounted on a carriage fixed to a flexible element that is payed in and out to advance and retract it.

In all of these systems the end positions of the bolt are determined by the various transmission and drive elements that are under considerable stress in the fully closed position of the door and in the partially closed position when the bolt is struck by the latch fork. As these elements wear, the bolt can assume the wrong position, and the stress in and of itself adds to the wear of these parts.

OBJECTS OF THE INVENTION

It is therefore an object of the present invention to provide an improved power-closing bolt for a motor-vehicle door latch.

Another object is the provision of such an improved power-closing bolt for a motor-vehicle door latch which overcomes the above-given disadvantages, that is which is of simple construction and where the bolt is solidly held in its fully closed position without undue stress on the drive elements that move it from the partially closed to the fully closed position.

SUMMARY OF THE INVENTION

A power-closing bolt assembly for a motor-vehicle door latch has according to the invention a housing, a bolt pivotal in the housing about a pivot axis between a pair of angularly offset end positions, and interengaging bolt and housing abutments respectively on the bolt and on the housing bearing angularly of the pivot axis on each other in each of the end positions. A drive displaces the bolt between the end positions. The housing abutments are spaced apart relative to the pivot axis by more than 180°.

Thus with this system in the end positions there is positive angular engagement between the abutments that fix the bolt in these end positions. This eliminates the need to provide a nonreversing or binding type of drive, since the drive is not stressed in the end positions. The result is therefore a simple structure and much less stress applied to the drive.

The bolt according to the invention has a pair of end parts seated in the housing and centered on the pivot axis and a center part between the end parts and centered on a bolt axis parallel to but offset from the pivot axis. The housing abutment is a tab projecting radially of the pivot axis outward from one of end parts. The housing abutments are typically spaced in a standard side-door latch offset from a horizontal plane by 5° to 10° and the abutment tab on the bolt has a relatively narrow angular dimension so that in the end positions the horizontal forces normally bearing on the bolt will have a vector pressing the abutments together, not apart. Thus the radial forces exerted on the bolt as the fork is engaged over it during closing and by the seal once it is in the fully closed position will not tend to pivot the bolt, will tend to hold it in the end positions.

The housing according to the invention is generally U-shaped and has a pair of cheeks each formed centered on the pivot axis with a seat pivotally receiving a respective one of the end parts.

The power-closing bolt assembly wherein one of the end parts is formed with a socket. The drive has an output shaft fitted to the socket. The shaft and socket have complementarily interfitting formations that only allow the shaft and socket to fit together in one angular position relative to each other. The drive includes an electric motor and a transmission connected to the electric motor and having the output shaft. The drive further includes a mounting plate carrying the motor and transmission, traversed by the drive shaft, and fixed to the housing. The housing abutments are spaced apart by more than 180° and are formed by angularly directed flanks of the housing and the bolt abutment is a radially outwardly projecting tab engageable n the end positions with the flanks.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
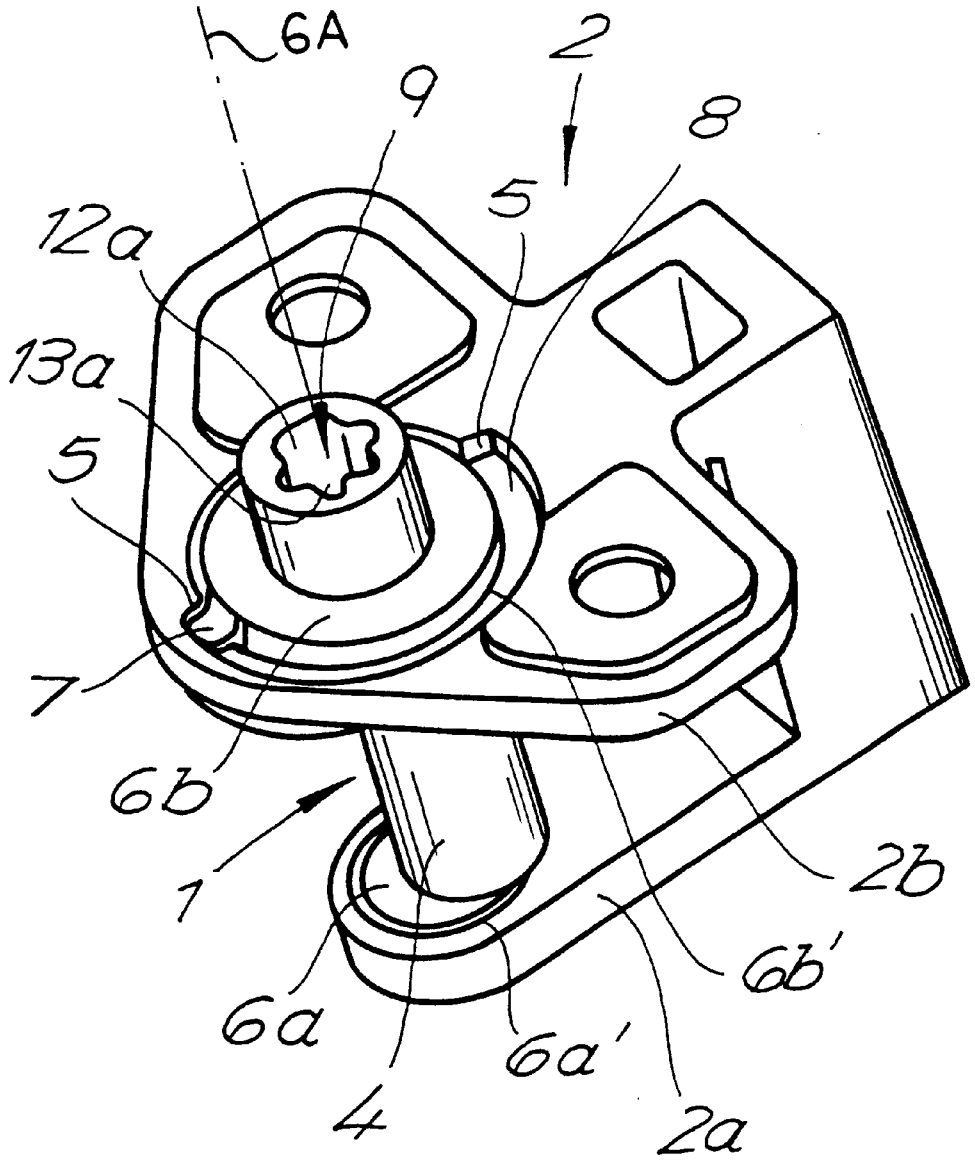
FIG. 1 is a perspective view of the bolt subassembly of the instant invention.
Figure 3:
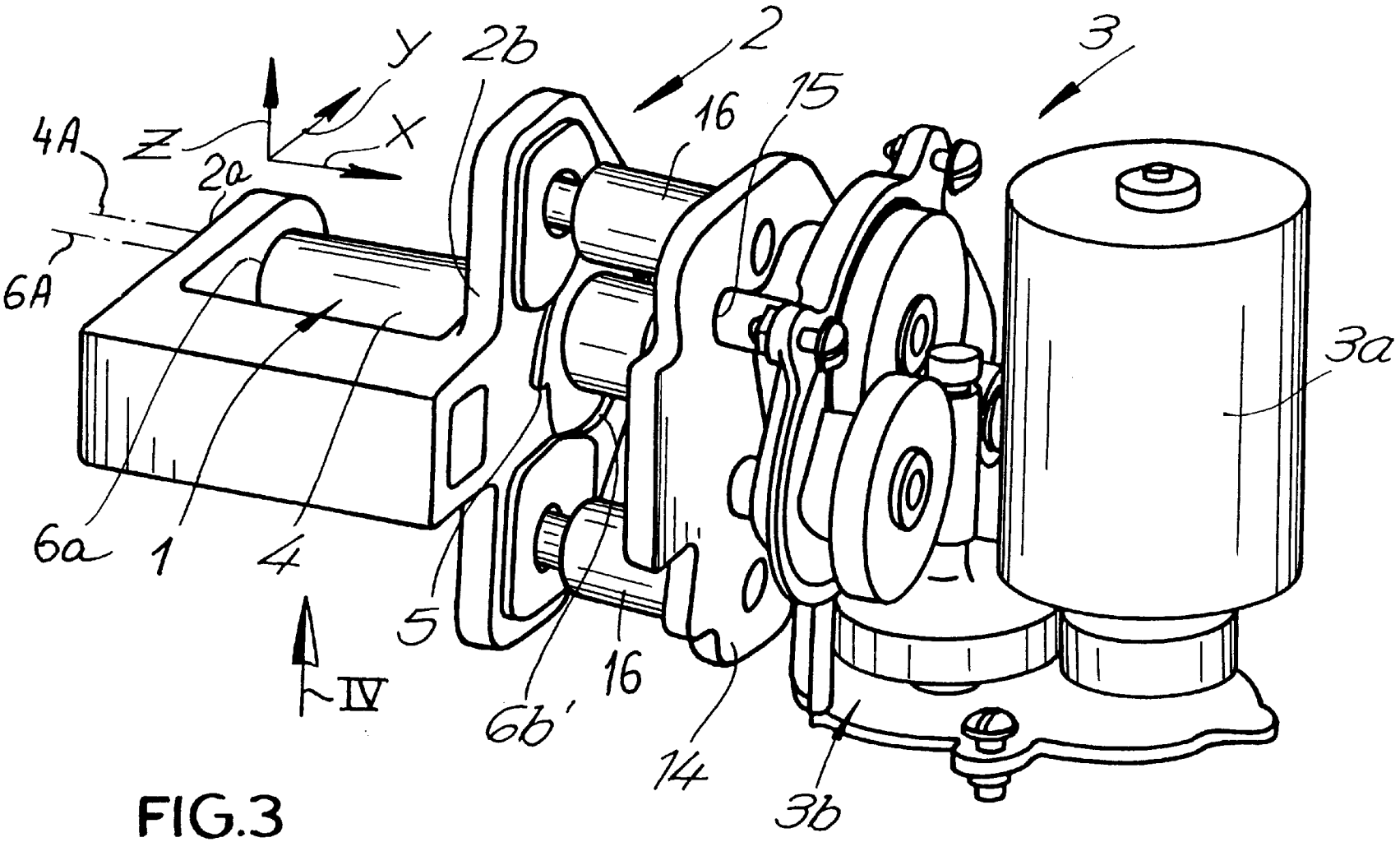
FIG. 3 is a perspective view of the entire power-closing bolt assembly in accordance with the invention.
Figure 4:
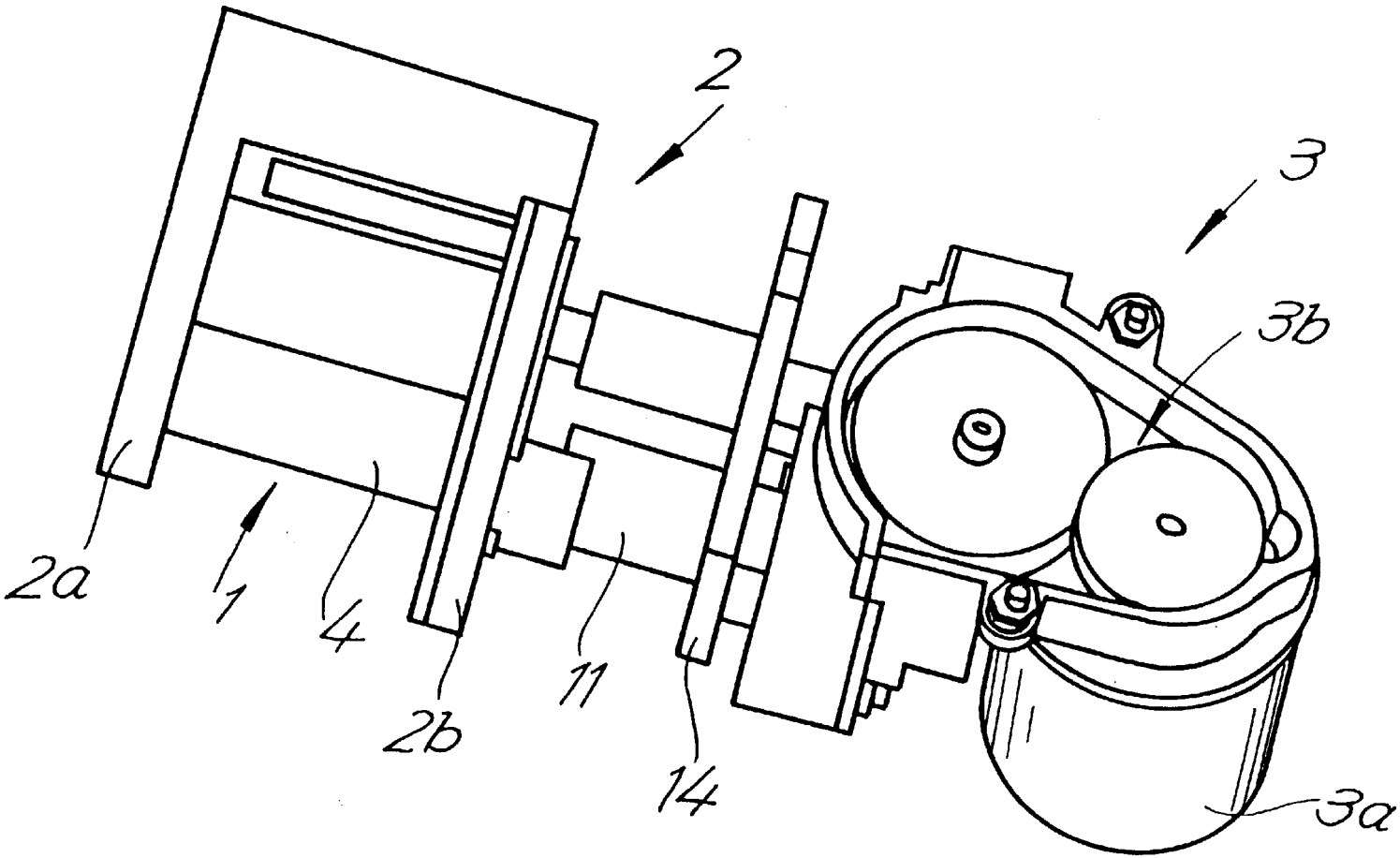
FIG. 4 is a view taken in the direction of arrow IV of FIG. 3.
Figure 5:
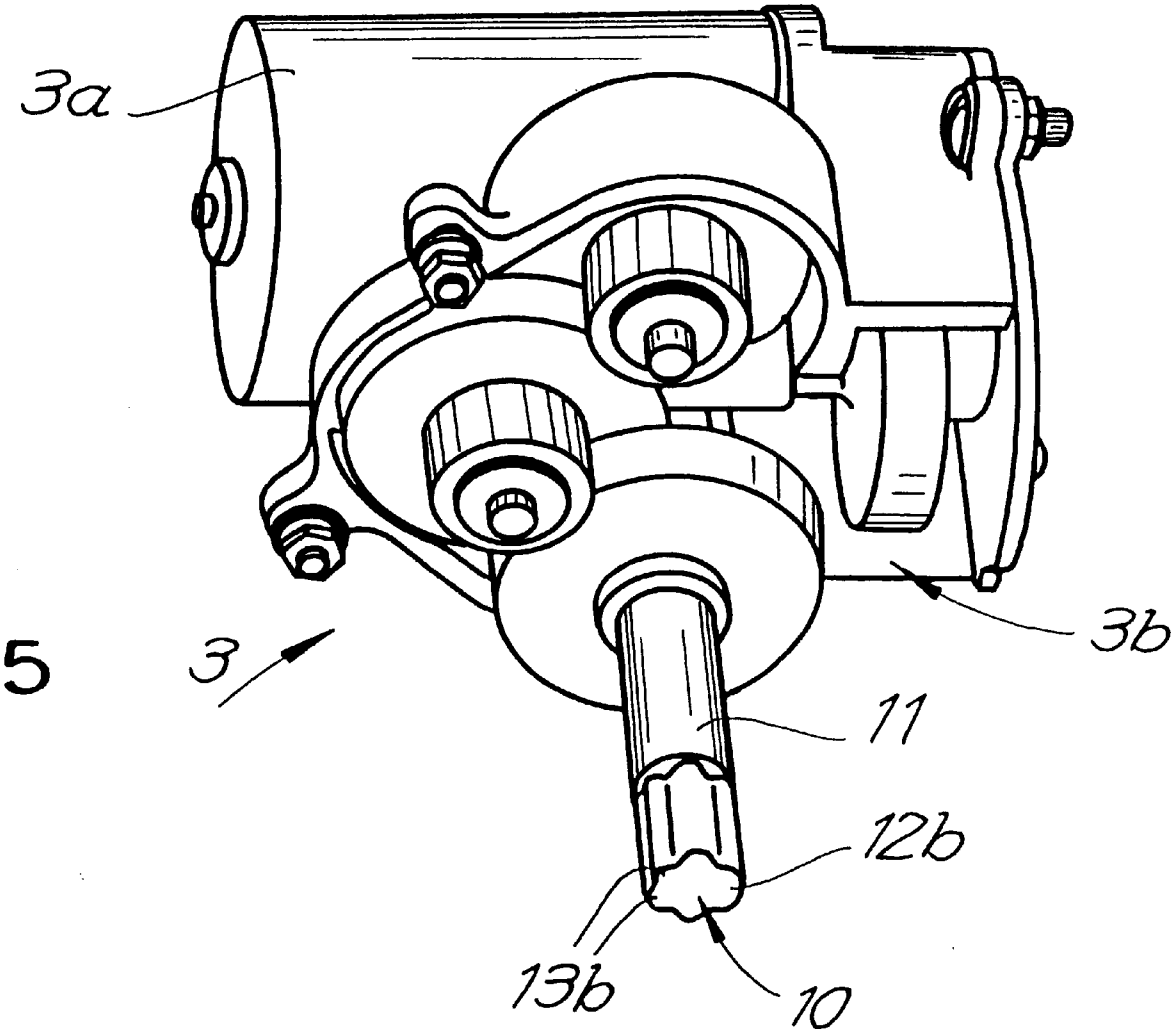
FIG. 5 is a perspective view of the drive subassembly of the instant invention.

As seen in FIG. 1 a bolt 1 is mounted in a U-shaped cast-metal support 2 secured to a drive subassembly 3 (FIGS. 3–5). The bolt 1 comprises a cylindrical center part 4 centered on an axis 4A and a pair of cylindrical end parts 6*a* and 6*b* received in respective seats 6*a*' and 6*b*' of cheeks or arms 2*a* and 2*b* of the support 2 and centered on an axis 6A offset from but parallel to the axis 4A.

Figure 2A:
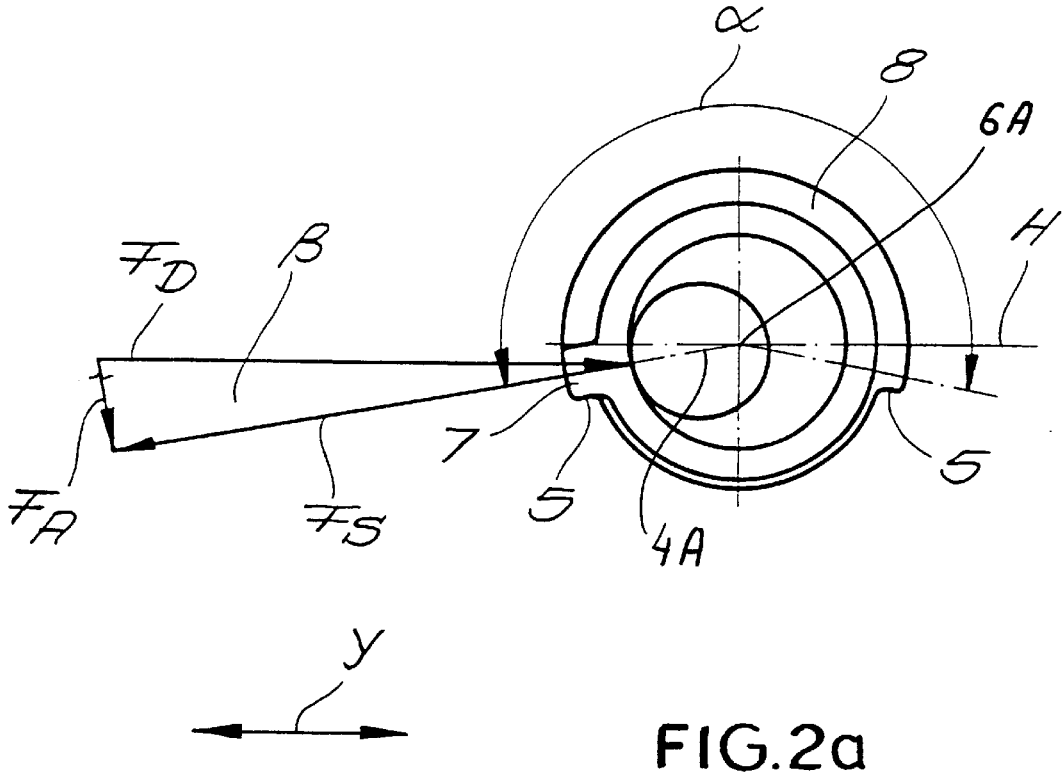
FIGS. 2*a* and 2*b* are diagrammatic views illustrating operation of the invention.
Figure 2B:
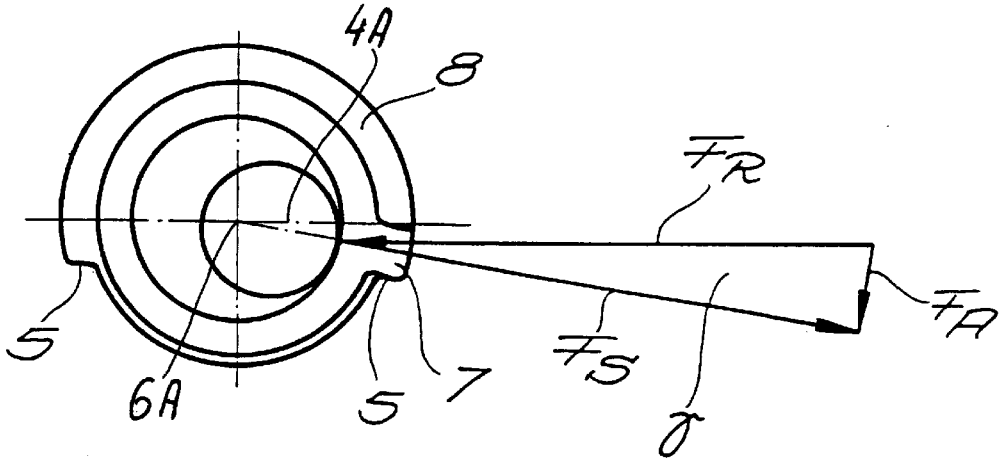

As also shown in FIGS. 2*a* and 2*b*, the cylindrical end part 6*b* is formed with a radially outwardly projecting abutment tab 7 that can orbit through an angle $\alpha$ of 195° in a groove 8 formed at the seat 6*b*' and having radially extending end flanks 5 forming angularly directed abutments against which the tab 7 can seat. Thus, relative to a normally horizontal diametral plane H passing through the axis 6A, the abutment tab 7 can move through an extra angle $\beta$ of between 5° and 10°, here 7.5°, in the fully closed position and an extra angle $\gamma$ between 5° and 10°, here of 7.5°, in the partially closed position.

FIG. 3 shows how the latch is oriented such that the axes 4A and 6A extend in an x direction parallel to a standard vehicular travel direction so as to move the door cooperating with the bolt 1 in a horizontal perpendicular direction y. A vertical axis or direction z is also shown. When the latch is used in a vehicle's trunk, the axes 4A and 6A can extend in the direction y.

Furthermore FIG. 2*a* shows how in the partially closed position the vectors of force resolve into a force $F_D$ parallel to the plane H and direction y which represents the manual closing force for the vehicle door, a resultant vector $F_S$ for the force exerted by the bolt 1 on the vehicle door, and the crosswise force $F_A$ that is applied to the abutment 5. In the fully closed position of FIG. 2*b* there is the force $F_R$ which is the force that the seal compressed between the door and the vehicle body exerts on the bolt 1 in the closing/opening direction y. It is particularly important according to the invention to note that the force $F_S$ that is actually applied to the bolt 1 in the partially and fully closed positions will not urge it into the other position, but instead will hold it in the set position. Thus, when the door is in either the fully or partially closed position, the resultant force vector $F_A$ is in a direction pressing the abutment tab 7 against the respective abutment 5. Hence the drive 3 need not be of the binding type since at rest the system will stay in the set positions.

The end of the bolt 1 at the leg 2*b* of the support 2 is formed as a socket 9 with a single wide axial groove 12*a* and plurality of uniform small-width axial grooves 13*a* (FIG. 1) that fit complementarily with a wide ridge 12*b* and narrow ridges 13*b* (FIG. 5) of an end 10 of an output shaft 11 of the drive 3. The formations 12*a* and 12*b* serve for angular alignment of the shaft 11 and bolt 1 so that they can only fit together in one position, thereby preventing misalignment of these parts. The shaft 11 is driven via a step-down transmission 3*b* from a small electric motor 3*a* whose output shaft extends parallel to direction z. A mounting plate 14 carrying the motor 3*a* and transmission 3*b* is secured by bolts 16 to the cheek 2*b* of the support 2 and has a hole 15 through which the shaft 11 passes.

We claim:

1. A power-closing bolt assembly for a motor-vehicle door latch, the assembly comprising:

a housing;

a bolt pivotal in the housing about a pivot axis between a pair of angularly offset end positions;

interengaging bolt and housing abutments respectively on the bolt and on the housing bearing angularly of the pivot axis on each other in each of the end positions, one of the end parts being formed with a socket; and drive means including an output shaft fitted to the socket for displacing the bolt between the end positions the shaft and socket having complementary interfitting formations that only allow the shaft and socket to fit together in one angular position relative to each other.

2. The power-closing bolt assembly defined in claim 1 wherein the housing abutments are spaced apart relative to the pivot axis by more than 180°.

3. The power-closing bolt assembly defined in claim 1 wherein the housing is generally U-shaped.

4. The power-closing bolt assembly defined in claim 3 wherein the housing has a pair of cheeks each formed centered on the pivot axis with a seat pivotally receiving a respective one of the end parts.

5. The power-closing bolt assembly defined in claim 1 wherein the drive means includes an electric motor, and a transmission connected to the electric motor and having the output shaft.

6. The power-closing bolt assembly defined in claim 5 wherein the drive means further includes a mounting plate carrying the motor and transmission, traversed by the output shaft, and fixed to the housing.

7. The power-closing bolt assembly defined in claim 1 wherein the housing abutments are spaced apart by more than 180° and are formed by angularly directed flanks of the housing and the bolt abutment is a radially outwardly projecting tab engageable in the end positions with the flanks.

8. The power-closing bolt assembly defined in claim 7 wherein the housing abutments are spaced apart by more than 190° and the tab has an angular dimension of less than 10°.

9. A power-closing bolt assembly for a motor-vehicle door latch, the assembly comprising:

a housing;

a bolt pivotal in the housing about a pivot axis between a pair of angularly offset end positions;

interengaging bolt and housing abutments respectively on the bolt and on the housing bearing angularly of the pivot axis on each other in each of the end positions, one of the end parts being formed with a socket; and drive means including an output shaft fitted to the socket for displacing the bolt between the end positions, an electric motor, a transmission connected to the electric motor and having the output shaft, and a mounting plate carrying the motor and transmission, traversed by the output shaft, and fixed to the housing.

10. The power-closing bolt assembly defined in claim 9 wherein the housing abutments are spaced apart relative to the pivot axis by more than 180°.

11. The power-closing bolt assembly defined in claim 9 wherein the housing is generally U-shaped.

12. The power-closing bolt assembly defined in claim 11 wherein the housing has a pair of cheeks each formed centered on the pivot axis with a seat pivotally receiving a respective one of the end parts.

13. The power-closing bolt assembly defined in claim 12 wherein the shaft and socket have complementarily interfitting formations that only allow the shaft and socket to fit together in one angular position relative to each other.

* * * * *